United States Patent [19]

Uno

[11] 4,352,143

[45] Sep. 28, 1982

[54] DEVICE FOR DISCHARGING STATIC ELECTRICITY AND METHOD OF PRODUCING THE SAME

[76] Inventor: Kenkichi Uno, 1407 80th St. SW., Everett, Wash. 98203

[21] Appl. No.: 153,269

[22] Filed: May 27, 1980

[51] Int. Cl.[3] ..... H05F 3/00; A46B 3/06

[52] U.S. Cl. ..... 361/221; 15/1.5 R

[58] Field of Search ..... 361/221, 214; 15/1.5 R, 15/1.5 A, 159 A; 300/8; 401/28

[56] References Cited

U.S. PATENT DOCUMENTS

| | | | |
|---|---|---|---|
| 2,449,972 | 9/1948 | Beach | 361/221 |
| 3,071,791 | 2/1963 | Cunningham et al. | 361/221 |
| 3,617,805 | 11/1971 | Truax | 361/218 |
| 3,636,408 | 12/1972 | Shuman | 361/221 |
| 3,673,472 | 6/1972 | Liebens | 361/221 |
| 3,757,164 | 9/1973 | Binkowski | 361/221 |
| 3,818,545 | 6/1974 | Olson et al. | 361/221 |

FOREIGN PATENT DOCUMENTS

| | | | |
|---|---|---|---|
| 2505198 | 8/1975 | Fed. Rep. of Germany | 300/8 |

*Primary Examiner*—J. D. Miller
*Assistant Examiner*—L. C. Schroeder

[57] ABSTRACT

A plurality of electrodes are formed, each of which is constituted by a bundle of 50 to 1,000 pieces of stainless steel fibers each having a diameter of 5 to 50$\mu$. Each bundle is twisted such that the number n of twist falls within the range of $0.1 \leqq n \leqq 3$. The electrodes are fixed at their base ends to a supportive frame at a right angle to the latter, such that the pitch of the electrodes is within 50 mm and the effective length of each electrode is not smaller than 3 mm. The bundles are released from twisting to obtain a larger width of each electrode at the free end of the latter than at the fixed base end of the same. In one form, the pieces of stainless steel fibers constitute warps. A plurality of groups of wefts are weamed into the warps at a right angle to the latter, such that the distance between the adjacent groups of wefts is not smaller than 3 mm. The wefts and warps are fixed at points of contacts therebetween. The warps are cut a portion in the close proximity of one side edge of each group of wefts such that the cut warps have an equal length. The warps and wefts may be fixed to each other by clamping both surfaces of the groups of wefts woven into warps by means of thermoplastic film and then heating and melting said thermoplastic films. The wefts may be made of a conductive yarn.

6 Claims, 10 Drawing Figures

Fig. 1
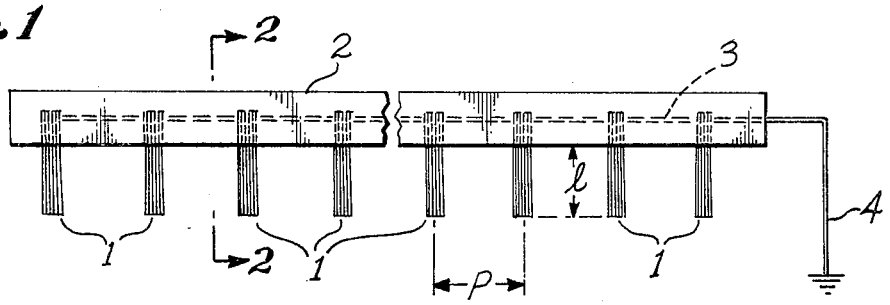
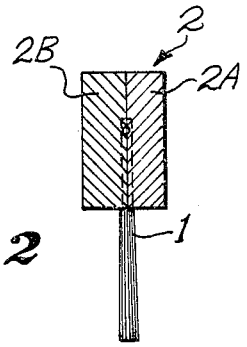
Fig. 2
Fig. 3
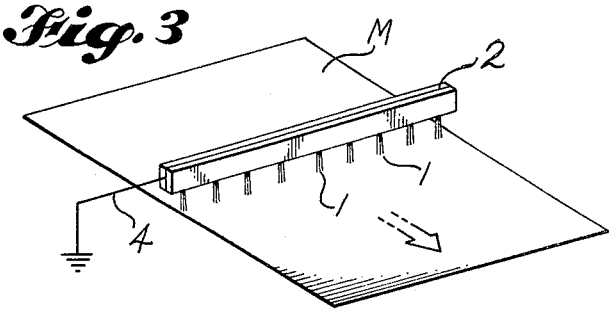
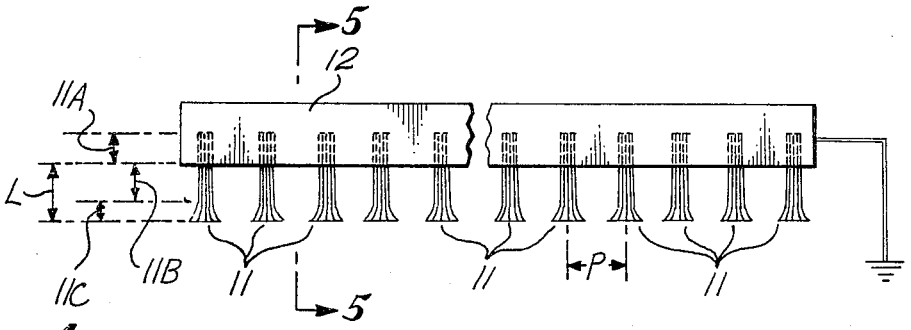
Fig. 4
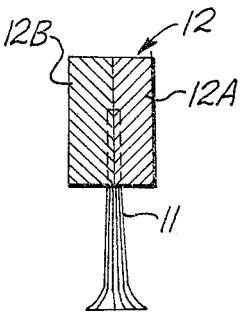
Fig. 5
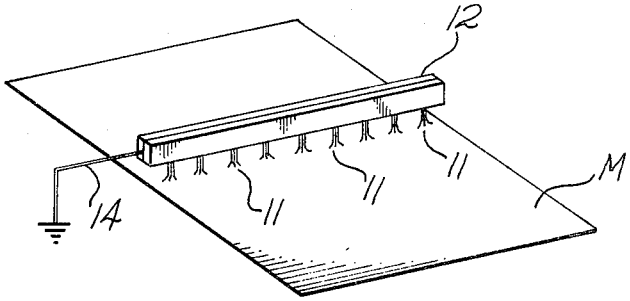
Fig. 6

DEVICE FOR DISCHARGING STATIC ELECTRICITY AND METHOD OF PRODUCING THE SAME

The present invention relates to a device for discharging static electricity from paper, plastic film, cloth and the like, particularly, a device of self-discharging type and suitable for discharge of static electricity of low voltage, as well as method of producing the same.

Impediments by static electricity poses problems in various fields of industries.

For instance, in the field of electronic copying machine, facsimile and so forth, the paper on which a printing is to be made is liable to be charged with static electricity. The static electricity on the paper hinders the attaching of ink to the paper to deteriorate the quality of the printing. The electricity also causes uneven edges of the papers.

Hitherto, various studies have been made to develop technics for discharging the static electricity, in order to obviate above-described problems. The technics for discharging static electricity heretofore developed can be broadly sorted into following types:

(1) self-discharging type (2) D.C. voltage application type (3) A.C. voltage application type The technics (2) and (3) listed above employ needle-like electrode to which a high voltage is applied so that a corona discharge is effected between the electrode and the charged object thereby to blow ions of reverse polarity to neutralize the charged object. These technics, therefore, require large scale and expensive apparatus for the application of the high voltage.

On the other hand, the self-discharging type method (1) employs a needle-like conductor (electrode for discharging electricity) of a small curvature disposed to oppose to the charged object. An electric field of a large density is formed around the apex of the needle-like conductor so that the air residing in the area around the apex is ionized to produce positive and negative ions. Among these ions, the ions of reverse polarity to that of the charged object are attracted to the charged object to neutralize the latter. Thus, the self-discharging type method has an advantage that the needle-like conductor requires no specific energy source. It is understood, however, that the larger effect of electricity discharge is obtained as the voltage of charge of the charged object is increased. This means that the discharge of the electricity cannot be made sufficiently when the voltage of charged object is low. In order to avoid this problem, it is necessary that the electrode for the discharge of electricity is held in direct contact with the charged object or in the close proximity of the latter. Conventionally, the electrode for discharge of electricity has been made of a cloth of yarns containing carbon fibers, metal fibers and so forth. When this type of electrode is used in contact with the charged object for the discharge of electricity, the contacting edge of the electrode is twisted or curled during the use to become out of contact or deflected away from the charged object, resulting in a much reduced effect of electricity discharge. Particularly, the carbon fibers which have small knot strength are liable to be broken or cut during the use, resulting not only the operation failure of the electrode but also in the deterioration of printing on paper or contamination of the plastic film or cloth by the fragments of the broken or cut carbon fibers. Also, in the case of the cloth of yarns having metal fibers mixed therein, the surface of the charged object is scratched or the finger of the operator is stabbed with the metal fibers, because the diameter of the latter is as large as several hundreds of microns. Thus, the cloth of yarns containing metal fibers is not considered appropriate as the material for the electrode for discharging the static electricity.

Under these circumstances, the present invention aims at providing a device for discharging static electricity capable of discharging the static electricity at a high efficiency even when the voltage of charge is low, not to mention to the case of high voltage of charge, as well as a method which permits such a device to be manufactured at a low cost.

The above and other objects as well as advantageous features of the invention will become clear from the following description of the preferred embodiments taken in conjunction with the accompanying drawings in which:

FIG. 1 is a front elevational view of a device for discharging static electricity having a supporting frame to which fixed are a plurality of electrodes each of which being constituted by a bundle of a plurality of fine stainless steel fibers;

FIG. 2 is a sectional view taken along the line A—A' of FIG. 4;

FIG. 3 is an illustration of the device for discharging static electricity as shown in FIG. 1 in the state of use;

FIG. 4 is a front elevational view of a device for discharging static electricity having a supporting frame to which fixed are a plurality of electrodes each of which are consisting of a bundle of fine stainless steel fibers having a compact base end and a diverging free end;

FIG. 5 is a sectional view taken along the line B—B' of FIG. 4;

FIG. 6 shows the state of device for static electricity shown in FIG. 4 in the state of use;

Figure 7:
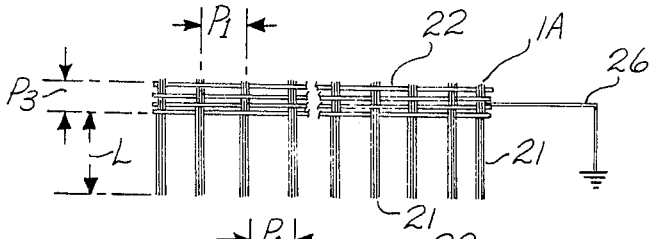
FIG. 7 is a front elevational view of a device for discharging static electricity having wefts woven into the base end portions of a plurality of electrodes each of which consisting of a bundle of fine stainless steel fibers.

Hereinafter, the preferred embodiments of the invention will be described with specific reference to the accompanying drawings.

Referring to the drawings, a plurality of electrodes 1, each of which consisting of 50 to 1,000 pieces of stainless steel fibers each having a diameter of 5 to 50$\mu$, are fixed to a supporting frame 2 at their base end portions, and are extended vertically from the supporting frame 2. The pitch or distance P between adjacent electrodes 2 is not greater than 50 mm, and the effective length l of the electrode extending vertically from the supporting frame 2 is not smaller than 3 mm. These electrodes 2 are electrically connected to each other.

The electrode of the device of the invention can be produced by bundling 50 to 1,000 pieces of long continuous fibers and cutting the bundle at a suitable length. Then, each of segments of the bundle is used as an electrode 1. Alternatively, the electrode 1 may be formed by bundling a multiplicity of short stainless steel fibers of a required length.

The stainless steel used for the constitution of the electrode should have a diameter of 5 to 50μ. A stainless steel fiber having a diameter smaller than 5μ can exhibit only insufficient resiliency and stiffness, whereas stainless steel fibers having a diameter in excess of 50μ will damage the charged object when it contacts the latter. Such small stainless steel fibers of a diameter falling within the above specified range can be obtained by heating and stretching a stainless steel fiber of a large diameter. The bundle of the stainless steel fibers constituting the electrode may be straight or twisted.

The supporting frame 2 can be made of various materials such as metals e.g. aluminum, stainless steel, and the like, plastics e.g. polyvinyl chloride, polyester, conductive resin containing conductive particles, wood and so forth.

The electrodes 1 are fixed at their base ends to the supporting frame 2. The fixing can be made in various ways. For instance, the electrodes 1 may be clamped at their base ends between a left and a right halves 2A,2B of the split type supporting frame 2, and bonded to the later by means of an adhesive. As another way of fixing, each electrode 1 is inserted into corresponding hole formed in one side of the supporting frame 2 and bonded to the latter by means of an adhesive. The diameter of the stainless steel constituting the electrode 1 is 5 to 50μ, and the number of the fibers is 50 to 1,000, so that the adhesive permeates into the fine space or gap between adjacent fibers to strongly bond the fibers.

The electrodes 1 on the supporting frames are electrically connected to one another. In case that the supporting frame 2 is made of a conductive material, the electric connection can be achieved simply by fixing the electrodes to the supporting frame. If not, the base portions of the electrodes may be interconnected by conductive wires of copper or the like, metal foils or connection pieces 3 of conductive plastic or the like. Alternatively, a connection pieces 3 is printed with a conductive paint or the like on the surface of the supporting frame 2 to which the electrode 1 are to be secured.

In case where the electrodes 1 are clamped between two halves 2A,2B of the supporting frame 2 and fixed by means of adhesive, or incase where the electrodes 1 are inserted into holes formed in one side of the supporting frame 2 and then fixed by an adhesive, it is recommended to use a conductive adhesive if the supporting frame 2 itself has a conductivity.

These electrodes have to be suitably earthed. If the supporting frame 2 itself is conductive, the earthing of the electrodes can be achieved by simply connecting an earthing line 4 to the supporting frame 2 itself. Alternatively, if the supporting frame 2 itself has no conductivity, the connection piece 3 interconnecting the electrodes 1 is grounded by an earthingline 4 or the connection piece 3 itself is extended to function as an earthing line 4.

Figure 10:
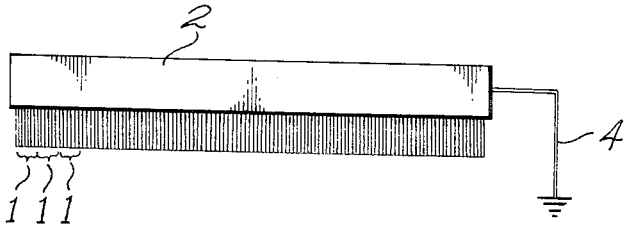
FIG. 10 is a front elevational view of a device for discharging the static electricity in which the distance between centers of the electrodes is substantially zero mm.

The pitch P of the electrodes 1,1 . . . , i.e. the distance between the enters of adjacent electrodes has to be not greater than 50 mm. The larger pitch P causes the deterioration of efficiency of discharge of the static electricity due to the reverse charging phenomenon or the like. Also, the effective length l is limited to be greater than 3 mm, because, when a conductive material is used as the material of the supporting frame 2, the charged object M and the supporting frame are too close to each other, to hinder the formation of non-uniform electric field, resulting in a lower efficiency of discharge of static electricity. The distance between adjacent electrodes 1,1 may be reduced substantially to zero, as shown in FIG. 10.

It is possible to provide a both-sided adhesive tape on one side of the supporting frame 2, so that it may be directly attached to a printing machine or the like. For obtaining a higher efficiency of discharge of the static electricity, it is preferred that the electrodes 1 are extended from the supporting frame 2 to oppose to the charged object M at a right angle to the latter.

The electrode 1 in the device of the invention, consisting of a bundle of 50 to 1,000 pieces of fine stainless steel fibers each having a diameter of 5 to 50μ and extended vertically from the supporting frame 2 over an effective length of 3 mm or larger, exhibits a sufficient resiliency and stiffness, as well as a high wear resistance, so that it can be used for a long time without suffering distortion or deflection to preserve an excellent electricity discharging performance for a long time, even when used in contact with or in close proximity of the charged object. In addition, the scratching of the object surface and stabbing of the operator's finger are fairly avoided. In addition, the electrode or the invention permits the discharge of the electricity not only at a high charging voltage but also when the voltage of charge is low. Further, the electrode 1 of the device of the invention made of stainless steel fibers can be cleaned also by buring, as well as washing by water or a solvent, when contaminated by dusts or the like. The electrode 1 exhibits a sufficient flexibility to make an even contact with the surface of the charged object M, regardless of whether the surface is flat or curved, to ensure a high efficiency of discharge of the static electricity, without hindering the running of the charged object M or damaging the same. The dropping of the individual stainless steel fiber is prevented because the electrode 1 is fixed at its base end portion to the supporting frame 2, while the breakage of the fiber does not take place because individual fibers has a sufficient strength. Therefore, various inconveniences attributable to the fragments of broken electrode, which have been inevitable in the conventional device, are fairly avoided.

FIG. 7 shows another embodiment of the invention in which the supporting frame of the first embodiment is substituted by a welf woven into the base portions of the electrodes. Namely, in the device for discharging static electricity shown in FIG. 7, each electrode is constituted by a warp 21 consisting of 50 to 1,000 pieces of stainless steel fibers each having a diameter of 5 to 50μ. Wefts 22 are woven only into the base portions 21A of the warps, and the points of contact between the warps and wefts are bonded. The pitch $P_1$, i.e. the distance between the centers of adjacent bundles of warps 21 is selected to be within 50 mm, while the effective length of the warps 21 as the electrodes, except the base portion 21A, is selected to be 3 mm or larger. The bundles of warps 21 are connected electrically.

The weft 22 may be made of a conductive yarn of metal fiber such as stainless steel fiber similar to that of warp, copper fiber, brass fiber and so forth, thermoplastic fiber such as polyvinyl chloride, nylon or the like, or a water soluble fiber. When a thermoplastic fiber is used as the weft 22, the latter can be bonded to the warp 21 by heating and, as required, prssing by means of a welder or a heat seal machine. Also, adjscent wefts 22 can be heat bonded in a similar manner. By so doing, it is possible to bond and fix the wefts 22 and warps 21 to each other.

When the weft 22 is made of a water soluble fiber, it can be bonded to the warp 21 and to another weft 22 by dissolution by water. The weft 22 and warp 21 can be of course bonded to each other by a known measure making use of an adhesive.

It is also possible, irrespective of whether the wefts 22 are conductive yarns or not, to coat both sides of weft group 22 with a thermoplastic film 22B and to apply heat and, as required, pressure by means of a welder or a heat seal machine to melt the thermoplastic film 22B, thereby to bond the weft 22 to the warp 21 and to another weft 22.

The device for discharging static electricity as shown in FIG. 7 can have a supporting frame installed at one or both sides of the group of wefts 22. This supporting frame may be similar to that used in the first embodiment shown in FIGS. 1 to 3, and is intended for maintaining the shape of the device reinforcing the group of weft 22 which is flexible and can hardly maintain the shape of the device by itself.

The device shown in FIG. 7 can provide an equivalent discharging effect to that of the first embodiment shown in FIGS. 1 to 3. In addition, the dropping of the stainless steel fibers is prevented because the base portions of the warps, i.e. the stainless steel fibers, are bonded to the group of wefts 22 woven thereinto. In addition, the group of wefts 22 exhibits a sufficient resiliency to permit the electrode consisting of the warps to follow uniformly the surface of the charged object even when the latter has a curved surface, so that a high efficiency of discharge of static electricity can be ensured irrespective of the shape of the surface of the charged object.

Figure 8:
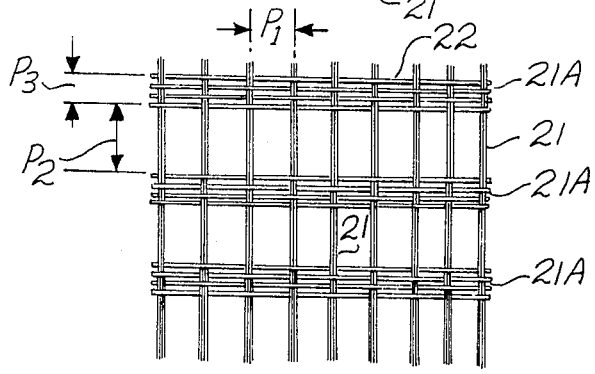
FIG. 8 is a partial front elevational view of an woven fabric used for the manufacture of the device for discharging the static electricity as shown in FIG. 7.
Figure 9:
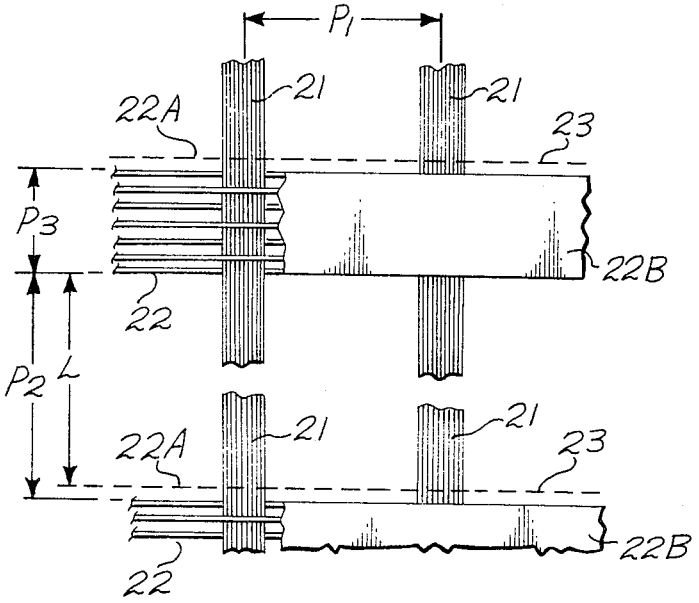
FIG. 9 is an enlarged partial front elevational view of a woven fabric used for the manufacture of a device for discharging the static electricity, having thermoplastic film heat-bonded to one side of a group of wefts.

FIGS. 8 to 9 in combination show a process for manufacturing at a high efficiency the device shown in FIG. 7 for the discharge of static electricity. According to this process, a plurality of warps 21, each consisting of a bundle of 50 to 1,000 pieces of stainless steel fibers of a diameter ranging between 5 to 50$\mu$, are arrayed in parallel. Then, a plurality of groups of wefts 22 having a width of $P_3$ are intermittently woven into the warps at a right angle to the latter, such that a space greater than 3 mm is formed between adjacent groups of weft 22. Subsequently, the warps 21 and wefts 22 are fixed. Finally, the wraps 21 are cut at portions 23 in parallel with one edge of the groups of wefts 22 in the vicinity of the latter. In this case, warps 21 are formed of a multiplicity of single continuous fibers compacted in the form of a bundle. Therefore, the groups of the wefts 22 which can be woven at a right angle to the warps 21 is a value which is obtained through dividing the length of the bundle of the warp 21 by the sum of the width $P_3$ of each group of weft 22 and the pitch $P_2$ of adjacent groups of weft 22, i.e. the effective length l of the warp 21 as an electrode.

By cutting the bundles of warps 21 of the cloth thus woven from the warps 21 and wefts 22 at portions 23 in parallel with one widthwise edge 22A of the weft 22, in the vicinity of that edge 22A, it is possible to produce a corresponding number of electricity discharge devices to that of the weft groups 22 woven into the cloth. If the weft 22 is conductive, the warps 21 are electrically connected to each other by the weft 22. If the weft 22 is not conductive, the warps 21 constituting the electrodes are connected at their base portions 21A by connection pieces such as conductive wire of copper or the like, or a piece of conductive plastic. In the former case, i.e. when the electric connection between the warps is made utilizing the conductivity of the weft 22 woven into the base portion 21A, it is preferred that the adhesive used for bonding the weft 22 and warp 21 has an electric conductivity.

According to this process, it is possible to produce a multiplicity of devices for discharging the static electricity, by forming a cloth by weaving groups of wefts 22 intermittently into a plurality of bundles of long warps 21, and cutting the warps 21 at portions 23 in parallel with one side edges 22A of the wefts 22 in the vicinity of the side edge 22A.

FIGS. 4 to 6 show still another embodiment of the invention in which each electrode has an increased width at at least the free end portion thereof. In this embodiment, a plurality of electrodes 11, each consisting of a bundle of 50 to 1,000 pieces of stainless steel fibers each having a diameter of 5 to 50$\mu$, are fixed at their base portions 11A to a supporting frame 12 and are extended at a right angle from the latter. In each electrode 11, the stainless steel fibers are diverged at at least the free end portion 11C of the electrode in the form of a broom. Thus, the free end portion 11C of the electrode 11 has a width greater than that of the base portion 11A thereof. The distance between the centers of adjacent electrodes is within 50 mm, while the effective length of each electrode including the free end portion 11C and intermediate portion 11B is greater than 3 mm. The electrodes 11 are electrically connected to one another. Needless to say, the electrodes of the device for removing static electricity shown in FIG. 7 can have the same shape as that shown in FIGS. 4 to 6.

The electrode which is diverged at at least its free end portion can be formed by cutting a bundle of straight long continuous stainless steel fibers at a suitable length and deforming the fibers of each segment of fiber bundle only at their free end portions such that they are parted from adjacent ones. It is also possible to form this electrode by bundling a plurality of short stainless steel fibers which are beforehand bent at required lengths. It is further possible to form this electrode by imparting a twisting to a bundle of stainless steel wire such that the number n of twist per until length (cm) falls within the range of $0.1 \leqq n \leqq 3$ and cutting the bundle at a suitable length after fixing it to the supporting frame.

Among these method, the most preferred one is to use the twisted bundle of stainless steel fibers, because it can eliminate the troublesome step of bending and suitable for mass-production. Namely, the electrodes made of twisted bundles of long stainless steel fibers are arrayed in parallel at a pitch of not greater than 50 mm, fixing a plurality of supporting frames of the twisted bundles of long stainless steel wires or weaving a plurality of groups of wefts into the same, such that the supporting frames or groups of wefts are arrayed perpendicular to the long stainless steel fibers constituting the bundles at a pitch of greater than 3 mm and cutting the bundles of the stainless steel fibers at equal length along one side edge of each supporting frame or wefts such that all cut bundles of stainless steel fibers have an equal length. As the cut bundles are left still, the free end of each bundle is opened due to the residual twist, while the base end which is fixed to the supporting frame or warp is kept compact, so that the electrode as a whole takes a form of a broom. By this process, it is possible to produce the above-mentioned type of electrode at a high efficiency.

The number n of twist per unit length (cm) smaller than 0.1 cannot provide a sufficient widening of the free end of the electrode as compared with the base end of the electrode. To the contrary, the number n of twist greater than 3 causes a too large twisting so that the ends of stainless steel fibers constituting the electrodes are wound or curled up to seriously deteriorate the efficiency of leakage of the static electricity.

The width of the electrode 11 may be increased only at the free end 11C thereof, while the intermediate portion 11B has a width equal to that of the base end portion 11A as shown in FIG. 4, or may be increased gradually over the intermediate and free end portions 11B, 11C.

The device for leaking static electricity shown in FIGS. 4 to 6 provides an effect equivalent to that presented by the device shown in FIGS. 1 to 3. In addition, since the stainless steel fibers of the electrode are opened at their free ends to provide a form like a broom, the free ends of the stainless steel fibers are distributed uniformly when the electrodes 1 of the device are used in contact with or close proximity of the charged object M to form good non-uniform electric fields. At the same time, since the area of contact between the electrode end and the charged object is increased, a good leakage of static electricity is performed even with reduced number of electrodes.

What is claimed is:

1. A method of producing a device for discharging static electricity comprising: forming a plurality of electrodes, each of which being constituted by a bundle of 50 to 1,000 pieces of stainless steel fibers each having a diameter of 5 to 50μ, said bundle being twisted such that the number n of twist falling within the range of $0.1 \leqq n \leqq 3$; fixing said electrodes at their base ends to a supporting frame at a right angle to the latter, such that the pitch of said electrodes is within 50 mm and the effective length of each electrode is not smaller than 3 mm; and releasing said bundles from twisting to obtain a larger width of each electrode at the free end of the latter than at the fixed base end of the same.

2. A device for discharging static electricity produced by the method of claim 1.

3. A method of producing a plurality of devices for discharging static electricity, comprising:

arraying a plurality of warps in a parallel relation, each of said warps consisting of a bundle of 50 to 1,000 pieces of stainless steel fibers each having a diameter of 5 to 50μ;

weaving a plurality of groups of wefts into said warps at a right angle to the latter, such that distance between adjacent groups of wefts is not smaller than 3 mm;

fixing said wefts and warps at the points of contact therebetween by clamping both surfaces of said groups of wefts woven into said warps by means of thermoplastic films and then heating and melting said thermoplastic films;

and cutting said warps at portions in the close proximity of one side edge of each group of weft such that the cut warps have an equal length.

4. A method of producing a plurality of devices for discharging static electricity, comprising:

arraying a plurality of warps in a parallel relation, each of said warps consisting of a bundle of 50 to 1,000 pieces of stainless steel fibers each having a diameter of 5 to 50μ;

weaving a plurality of groups of conductive yarn into said warps at a right angle to the latter, such that distance between adjacent groups of wefts is not smaller than 3 mm;

fixing said wefts and warps at the points of contact therebetween;

and cutting said warps at portions in the close proximity of one side edge of each group of weft such that the cut warps have an equal length.

5. A method of producing a device for discharging static electricity, comprising:

arraying a plurality of warps in a parallel relation, each of said warps consisting of a bundle of 50 to 1,000 pieces of stainless steel fibers each having a diameter of 5 to 50μ;

weaving a plurality of wefts into said warps at a right angle to the latter, to provide warp portions extending from said wefts a distance no smaller than 3 mm, to function as electrodes;

fixing said wefts and warps at the points of contact therebetween;

and electrically connecting the warp portions to one another in the region of the wefts; and said warps and wefts being fixed to each other by clamping both surfaces of said wefts woven into said warps by means of thermoplastic films and then heating and melting said thermoplastic films.

6. A method of producing a device for discharging static, comprising:

arraying a plurality of warps in a parallel relation, each of said warps consisting of a bundle of 50 to 1,000 pieces of stainless steel fibers each having a diameter of 5 to 50μ;

weaving a plurality of wefts into said warps at a right angle to the latter, to provide warp portions extending from said wefts a distance no smaller than 3 mm, to function as electrodes;

fixing said wefts and warps at the points of contact therebetween;

and electrically connecting the warp portions to one another in the region of the wefts; and wherein said weft is made of a conductive yarn.

* * * * *